US011452414B2

(12) United States Patent
Mathias et al.

(10) Patent No.: US 11,452,414 B2
(45) Date of Patent: Sep. 27, 2022

(54) REPLACEMENT HEAD FOR A VACUUM

(71) Applicant: SharkNinja Operating LLC, Needham, MA (US)

(72) Inventors: Richard Mathias, Needham, MA (US); Brandon J. Suleski, Cambridge, MA (US); James P. Bilodeau, Littleton, MA (US); Michael Douglas, London (GB); Yu Ri Young Kim, Brighton, MA (US); Samuel Emrys James, London (GB)

(73) Assignee: SHARKNINJA OPERATING LLC, Needham, MA (US)

( * ) Notice: Subject to any disclaimer, the term of this patent is extended or adjusted under 35 U.S.C. 154(b) by 0 days.

(21) Appl. No.: 16/670,103

(22) Filed: Oct. 31, 2019

(65) Prior Publication Data

US 2021/0127920 A1 May 6, 2021

(51) Int. Cl.
*A47L 9/06* (2006.01)
*A47L 9/12* (2006.01)

(52) U.S. Cl.
CPC ..... *A47L 9/0673* (2013.01); *A47L 9/066* (2013.01); *A47L 9/0626* (2013.01); *A47L 9/0666* (2013.01); *A47L 9/122* (2013.01)

(58) Field of Classification Search
CPC .... A47L 9/0686; A47L 9/0673; A47L 9/0666; A47L 9/066; A47L 9/122; A47L 11/29; A47L 11/30; A47L 11/4036
USPC ..... 15/415.1
See application file for complete search history.

(56) References Cited

U.S. PATENT DOCUMENTS 490,472 A 1/1893 Clements
2,055,734 A 9/1936 Sparklin
RE20,489 E * 8/1937 Leathers ..... A47L 5/28 15/410
D117,388 S 10/1939 Woinarovicz
(Continued)

FOREIGN PATENT DOCUMENTS

CN 1764405 A 4/2006
CN 1889881 A 1/2007
(Continued)

OTHER PUBLICATIONS

Amazon.com—Shark Genius Steam Pocket Mop Hard Floor Cleaner, oldest reviews 2016, https://www.amazon.com/Cleaner-Blaster-Technology-Intelligent-S5003D/dp/B01 KU4BSGK/ref=cm_cr arp_d_product_top?ie=UTF8, site visited Oct. 11, 2018.
(Continued)

*Primary Examiner* — Brian D Keller
(74) *Attorney, Agent, or Firm* — Mintz Levin Cohn Ferris Glovsky and Popeo, PC; Lisa Adams

(57) ABSTRACT

A replacement head for a vacuum device includes a plastic tray, a filter and a pad. The plastic tray includes a dust chamber, a first connector lip and a second connector lip. An opening is provided that allows air, dust and debris to be drawn into the dust chamber during use. The connector lips are provided for attachment to a vacuum device. The pad is attached to the lower side of the plastic tray and is in contact with the floor during cleaning. The filter is connected to the plastic tray such that the filter substantially covers a top opening in the dust chamber.

29 Claims, 21 Drawing Sheets

(56) References Cited

U.S. PATENT DOCUMENTS 3,050,761 A * 8/1962 Morgan ..... A47L 13/14 15/119.2
D214,977 S 8/1969 Roth
3,814,124 A 6/1974 Bell
4,011,624 A 3/1977 Proett
4,063,326 A 12/1977 Fromknecht
D247,949 S 5/1978 Tillinghast et al.
D250,245 S 11/1978 Bebb
D278,099 S 3/1985 Evans
4,545,794 A 10/1985 Himukai
4,610,047 A 9/1986 Dick et al.
4,706,327 A 11/1987 Getz et al.
5,365,881 A 11/1994 Sporn
5,664,285 A 9/1997 Melito et al.
5,829,090 A 11/1998 Melito et al.
D423,157 S 4/2000 Hodges
6,102,278 A 8/2000 Rothas
6,117,200 A 9/2000 Berg et al.
6,453,506 B1 9/2002 Summer
6,571,421 B1 6/2003 Sham et al.
6,797,357 B2 9/2004 Fereshtehkhou et al.
6,799,351 B2 10/2004 Porath
6,966,098 B2 11/2005 Sako et al.
7,013,528 B2 3/2006 Parker et al.
7,048,804 B2 5/2006 Kisela et al.
7,137,169 B2 11/2006 Murphy et al.
7,150,069 B2 12/2006 Hori et al.
D548,907 S 8/2007 Killen
7,293,322 B2 11/2007 Matousek et al.
7,329,294 B2 2/2008 Conrad
7,337,494 B2 3/2008 Baer et al.
7,409,745 B2 8/2008 Dodson et al.
7,418,763 B2 9/2008 Shaver et al.
7,451,519 B2 11/2008 Nishinaka et al.
D597,717 S 8/2009 Rosenzweig et al.
7,673,361 B2 3/2010 Policicchio et al.
7,676,877 B2 3/2010 Policicchio et al.
7,861,351 B2 1/2011 Ho
7,934,287 B2 5/2011 De Soto-Burt et al.
8,020,236 B2 9/2011 Kaleta et al.
8,062,398 B2 11/2011 Luo et al.
8,065,778 B2 11/2011 Kim et al.
D661,034 S 5/2012 Ediger et al.
D672,107 S 12/2012 Van Landingham, Jr. et al.
8,341,802 B2 1/2013 Kim et al.
8,458,850 B2 6/2013 Kasper et al.
8,495,781 B2 7/2013 Dingert
8,584,309 B2 11/2013 Santiago
D703,407 S 4/2014 Xiong
8,769,764 B2 7/2014 Crouch et al.
D731,137 S 6/2015 Colangelo
D764,127 S 8/2016 Vicari et al.
D766,584 S 9/2016 Blouin et al.
9,504,366 B2 11/2016 Kasper et al.
9,545,180 B2 1/2017 Conrad
9,560,944 B2 2/2017 Grey
9,661,968 B2 5/2017 Bradbury
9,788,695 B2 10/2017 Wood
D804,123 S 11/2017 Orsino
9,883,780 B2 2/2018 Kim et al.
9,901,231 B2 2/2018 Tibberts
D817,574 S 5/2018 Libman et al.
2003/0159230 A1 8/2003 Oh
2003/0217432 A1 11/2003 Oh et al.
2003/0221274 A1 12/2003 Makhija et al.
2004/0045126 A1 3/2004 Parker et al.
2004/0134016 A1 7/2004 Kisela et al.
2004/0134025 A1 7/2004 Murphy et al.
2004/0139572 A1 7/2004 Kisela et al.
2004/0141798 A1 7/2004 Garabedian, Jr. et al.
2004/0168281 A1* 9/2004 Sako ..... A47L 9/06 15/364
2004/0211022 A1 10/2004 Fan
2004/0250376 A1 12/2004 Hori et al.
2005/0115409 A1 6/2005 Conrad
2005/0132680 A1 6/2005 Wegelin et al.
2005/0193516 A1 9/2005 Hughes
2006/0000052 A1 1/2006 Budd
2006/0123590 A1* 6/2006 Fester ..... A47L 9/1683 15/353
2007/0061040 A1 3/2007 Augenbraun et al.
2007/0245511 A1 10/2007 Hahm et al.
2007/0251050 A1 11/2007 Harsh et al.
2008/0040876 A1 2/2008 Aiyar
2008/0235899 A1 10/2008 Haan
2008/0276407 A1 11/2008 Schnittman et al.
2009/0100636 A1 4/2009 Sohn et al.
2010/0024155 A1 2/2010 Policicchio et al.
2010/0024156 A1 2/2010 De Soto-Burt et al.
2010/0024157 A1 2/2010 Vernon et al.
2010/0115719 A1 5/2010 West et al.
2010/0251497 A1 10/2010 Arnold
2010/0306939 A1 12/2010 Dingert
2011/0088209 A1 4/2011 Ivarsson
2012/0110775 A1 5/2012 Krebs
2012/0159728 A1 6/2012 Suda et al.
2012/0311813 A1 12/2012 Gilbert, Jr. et al.
2013/0055521 A1 3/2013 Lee et al.
2013/0291333 A1 11/2013 Grey
2014/0033470 A1 2/2014 Codling
2014/0033471 A1 2/2014 Toole et al.
2015/0101617 A1 4/2015 Duffy
2015/0128364 A1 5/2015 Dooley et al.
2015/0223662 A1 8/2015 Doherty-Stapp et al.
2015/0250368 A1 9/2015 Kim et al.
2016/0100735 A1 4/2016 Milanese et al.
2016/0174793 A1 6/2016 Burke et al.
2016/0278594 A1 9/2016 Bradbury
2016/0353963 A1 12/2016 Kellis et al.
2017/0007086 A1 1/2017 Kleine-Doepke et al.
2017/0119223 A1 5/2017 Staf
2017/0202421 A1 7/2017 Hwang et al.
2018/0014711 A1* 1/2018 Rostami ..... B29C 66/71
2018/0035855 A1 2/2018 Wood
2018/0055315 A1 3/2018 Conrad
2018/0177367 A1 6/2018 Amaral et al.
2018/0220861 A1 8/2018 Zhang et al.
2019/0075984 A1 3/2019 James et al.
2019/0269289 A1 9/2019 Xu et al.
2019/0274496 A1 9/2019 James et al.
2019/0274497 A1 9/2019 James et al.
2019/0274498 A1 9/2019 James et al.
2019/0274500 A1 9/2019 Thorne et al.
2019/0282045 A1 9/2019 James et al.
2021/0015320 A1 1/2021 James et al.

FOREIGN PATENT DOCUMENTS

CN 101061929 A 10/2007
CN 102112030 A 6/2011
CN 102961085 A 3/2013
CN 103356140 A 10/2013
CN 205181229 U 4/2016
CN 107028564 A 8/2017
CN 209595637 U 11/2019
DE 667452 C 11/1938
EP 1027844 A2 8/2000
EP 1219222 A1 7/2002
EP 1525839 A2 4/2005
GB 2161902 A 1/1986
JP 2003326121 A 11/2003
JP 2006198083 A 8/2006
JP 2008206944 A 9/2008
JP 2008228768 A 10/2008
JP D1489801 S 2/2014
JP 2014200435 A 10/2014
KR 1020060112749 A 11/2006
KR 20170043227 A 4/2017
WO 2004062454 A2 7/2004
WO 2004062457 A2 7/2004
WO 2005018402 A2 3/2005
WO 2010014366 A1 2/2010
WO 2010014367 A1 2/2010
WO 2011017493 A1 2/2011

(56) References Cited

FOREIGN PATENT DOCUMENTS

| | | | |
|---|---|---|---|
| WO | 2011112545 | A2 | 9/2011 |
| WO | 2014020303 | A1 | 2/2014 |
| WO | 2014104503 | A1 | 7/2014 |
| WO | 2016022270 | A1 | 2/2016 |
| WO | 2016062647 | A1 | 4/2016 |
| WO | 2016095040 | A1 | 6/2016 |
| WO | 2016100964 | A2 | 6/2016 |
| WO | 2017144918 | A1 | 8/2017 |
| WO | 2019051431 | A1 | 3/2019 |

OTHER PUBLICATIONS

International Search Report; Application No. PCT/US2018/050308; dated Nov. 26, 2018; 3 pages.
U.S. Appl. No. 16/718,875, filed Dec. 18, 2019, Cleaning Device.
U.S. Appl. No. 17/089,555, filed Nov. 4, 2020, Cleaning Device.
U.S. Appl. No. 16/670,039, filed Oct. 31, 2019, Replacement Head for a Vacuum.
U.S. Appl. No. 16/670,476, filed Oct. 31, 2019, Comet, Replacement Head Filter.
U.S. Appl. No. 16/126,549, filed Sep. 10, 2018, Cleaning Device.
U.S. Appl. No. 16/420,453, filed May 23, 2019, Cleaning Device.
U.S. Appl. No. 16/420,475, filed May 23, 2019, Cleaning Device.
U.S. Appl. No. 16/420,498, filed May 23, 2019, Cleaning Device.
U.S. Appl. No. 16/429,306, filed Jun. 3, 2019, Cleaning Device.
U.S. Appl. No. 17/038,975, filed Sep. 30, 2020, Cleaning Device.
U.S. Appl. No. 17/039,057, filed Sep. 30, 2020, Cleaning Device.
U.S. Appl. No. 17/039,103, filed Sep. 30, 2020, Cleaning Device.
U.S. Appl. No. 17/039,155, filed Sep. 30, 2020, Cleaning Device.
U.S. Appl. No. 17/039,814, filed Sep. 30, 2020, Cleaning Device.
U.S. Appl. No. 17/039,725, filed Sep. 30, 2020, Cleaning Device.
U.S. Appl. No. 17/062,432, filed Oct. 2, 2020, Cleaning Device.
U.S. Appl. No. 17/062,455, filed Oct. 2, 2020, Cleaning Device.
U.S. Appl. No. 17/062,489, filed Oct. 2, 2020, Cleaning Device.
U.S. Appl. No. 17/062,540, filed Oct. 2, 2020, Cleaning Device.
U.S. Appl. No. 17/067,537, filed Oct. 9, 2020, Cleaning Device.
U.S. Appl. No. 16/896,762, filed Jun. 9, 2020, Cleaning Device.
U.S. Appl. No. 16/671,220, filed Nov. 1, 2019, Cleaning Device.
U.S. Appl. No. 17/089,575, filed Nov. 4, 2020, Cleaning Device.
U.S. Appl. No. 16/718,725, filed Dec. 18, 2019, Cleaning Device.
U.S. Appl. No. 17/039,137, filed Sep. 30, 2020, Cleaning Device.
U.S. Appl. No. 17/091,983, filed Nov. 6, 2020, Cleaning Device.
U.S. Appl. No. 17/104,229, filed Nov. 25, 2020, Cleaning Device.
U.S. Appl. No. 17/091,945, filed Nov. 6, 2020, Cleaning Device.
U.S. Appl. No. 17/067,521, filed Oct. 9, 2020, Cleaning Device System and Method for Use.
U.S. Appl. No. 17/089,532, filed Nov. 4, 2020, Cleaning Device System and Method for Use.
U.S. Appl. No. 16/795,012, filed Feb. 19, 2020, Cleaning Device System and Method for Use.
International Search Report and Written Opinion received for PCT Application No. PCT/IB2020/062158, dated Mar. 24, 2021, 11 pages.
Extended European Search Report received for EP Application No. 18854457.1, dated Apr. 2, 2020, 5 pages.
Extended European Search Report received for EP Application No. 19215569.5, dated May 15, 2020, 5 pages.
International Preliminary Report on Patentability received for PCT Application No. PCT/US2018/050308, dated Mar. 26, 2020, 13 pages.
International Search Report and Written Opinion received for PCT Application No. PCT/US2019/059327, dated Feb. 6, 2020, 10 pages.
International Search Report and Written Opinion received for PCT Application No. PCT/US2019/067121, dated May 7, 2020, 12 pages.
International Search Report and Written Opinion received for PCT Application No. PCT/US2020/058146, dated Feb. 2, 2021, 13 pages.
International Search Report and Written Opinion received for PCT Application No. PCT/US2020/058162, dated Feb. 2, 2021, 12 pages.
International Search Report and Written Opinion received for PCT Application No. PCT/US2020/059491, dated Feb. 2, 2021, 9 pages.
International Search Report and Written Opinion received for PCT Application No. PCT/US2020/059503, dated Feb. 3, 2021, 7 pages.
International Search Report and Written Opinion received in PCT Application No. PCT/US2020/058195, dated Dec. 21, 2020, 13 pages.
Invitation to Pay Additional Fees received for PCT Application No. PCT/US2020/062158, dated Jan. 11, 2021, 2 pages.
(Aug. 1, 2019) N.K. Multi-Tech Filters Pvt. Limited, Available at: https://www.airfiltersindia.net/product_temp_No_Upload.html, 4 Pages.
Extended European Search Report issued in European Application No. 21212780.7, dated Apr. 4, 2022, 5 pages.

* cited by examiner

REPLACEMENT HEAD FOR A VACUUM

FIELD OF THE INVENTION

The present disclosure relates generally to replacement heads for cleaning devices, and more specifically to replacement heads for certain vacuum devices.

BACKGROUND

Hardfloor cleaning can be challenging when there are a variety of mixed media debris present. In some instances, there is a desire to both vacuum dry, loose debris, scrub stuck debris and absorb any wet debris that may be present. Prior art tools, such as vacuums, dry mops and wet mops are capable of handling some of these types of media, but not all at once. As a result, many often sweep dry debris before mopping wet or stuck-on debris.

Known tools that can handle both dry and wet media have higher set-up times than a broom/mop combination and the after-use maintenance can be especially high when liquids are involved. If the combination tool is not properly cleaned after each use, they can become smelly and unpleasant. Lastly, clean up can be quite messy and the user may be required to either dirty his or her hands and/or wear gloves.

Therefore, an improved hardfloor cleaner that can be easily attached and detached to a vacuum device with minimal effort and mess is desired.

SUMMARY

According to one aspect of the invention, the replacement head includes a filter, a plastic tray and a pad. The plastic tray that includes a dust chamber, a first connector lip and a second connector lip. The dust chamber defines a top opening bounded by a sealing surface. The dust chamber also has a bottom wall, a front wall, a rear wall, a left wall and a right wall. The bottom wall of the dust chamber defines an exterior bottom surface. An opening extends through at least one of the walls (preferably, the front wall) into the dust chamber. The first connector lip extends outwards from at least a portion of the left wall of the dust chamber and at least partially between the front surface and the rear surface of the dust chamber, the first connector lip having a lower surface that is positioned between the sealing surface and the second surface of the pad. The second connector lip extends outwards from at least a portion of the right wall of the dust chamber and at least partially between the front surface and the rear surface of the dust chamber, the second connector lip having a lower surface that is positioned between the sealing surface and the second surface of the pad. The pad includes at least one layer of material and defines a first surface and a second surface. The first surface is connected to bottom wall of the plastic tray and the second surface generally faces away from the first surface. The filter is connected to the plastic tray such that the filter substantially covers the top opening.

According to another aspect of the invention, the first and/or second connector lips may have a shape that includes at least one curve.

According to a further aspect of the invention, the first and/or second connector lips can extend from a position rearward of the rear wall of the dust chamber to a position forward of the front wall of the dust chamber.

According to an even further aspect of the invention, the first and/or second connector lips are integral and extend along at least one of the rear wall and the front wall.

According to an even further aspect of the invention, the lower surface of the first and/or second connector lips are closer to the sealing surface than the second surface of the pad.

According to an even further aspect of the invention, the replacement head can include a front guard portion.

One advantage of the present invention is that the user can easily remove and replace a soiled replacement head with a fresh replacement head in a short amount of time with very little mess.

DETAILED DESCRIPTION OF THE INVENTION

Figure 1:
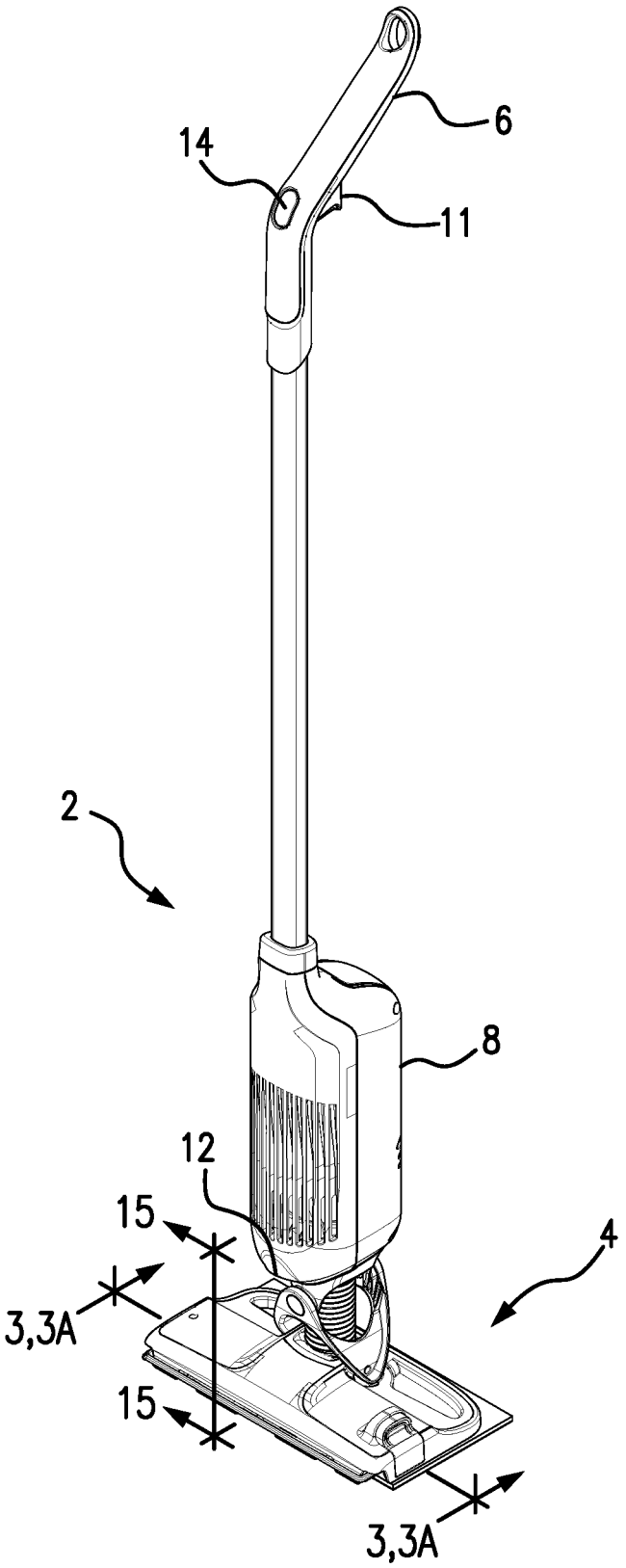
FIG. 1 shows an isometric view of a vacuum device and replacement head of the present invention.
Figure 2:
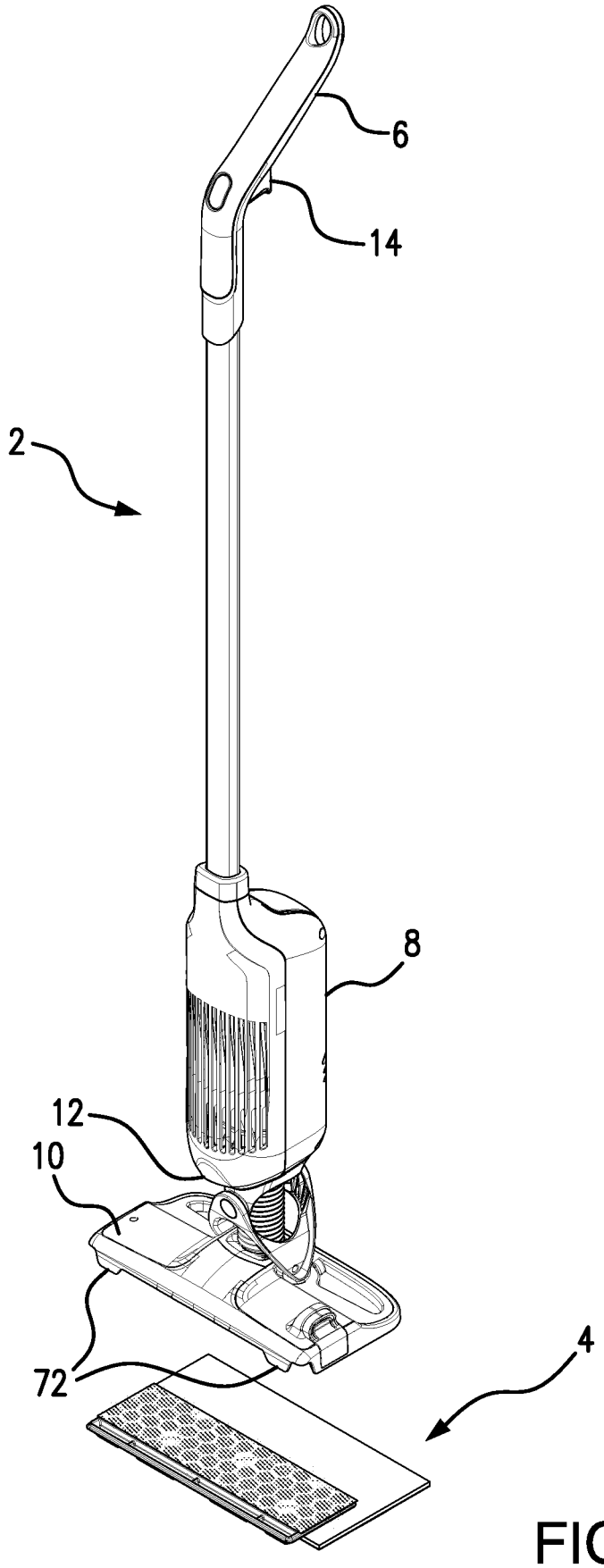
FIG. 2 shows an isometric view of the vacuum device and replacement head of FIG. 1 separated from one another.
Figure 3:
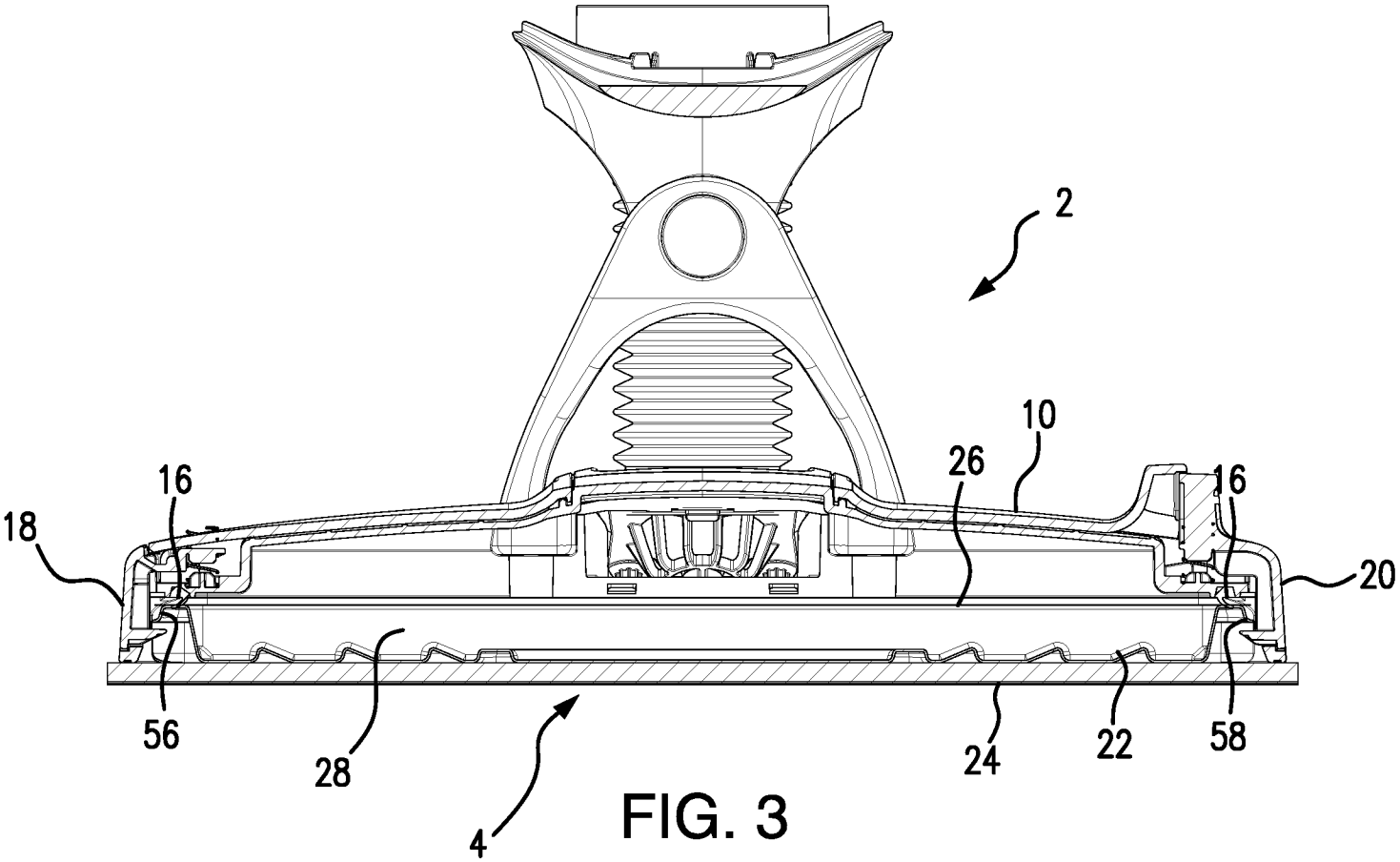
FIG. 3 shows a cross-sectional view of FIG. 1 along line 3-3 showing the vacuum head and replacement head attached and with connector arms in the locked position.
Figure 3A:
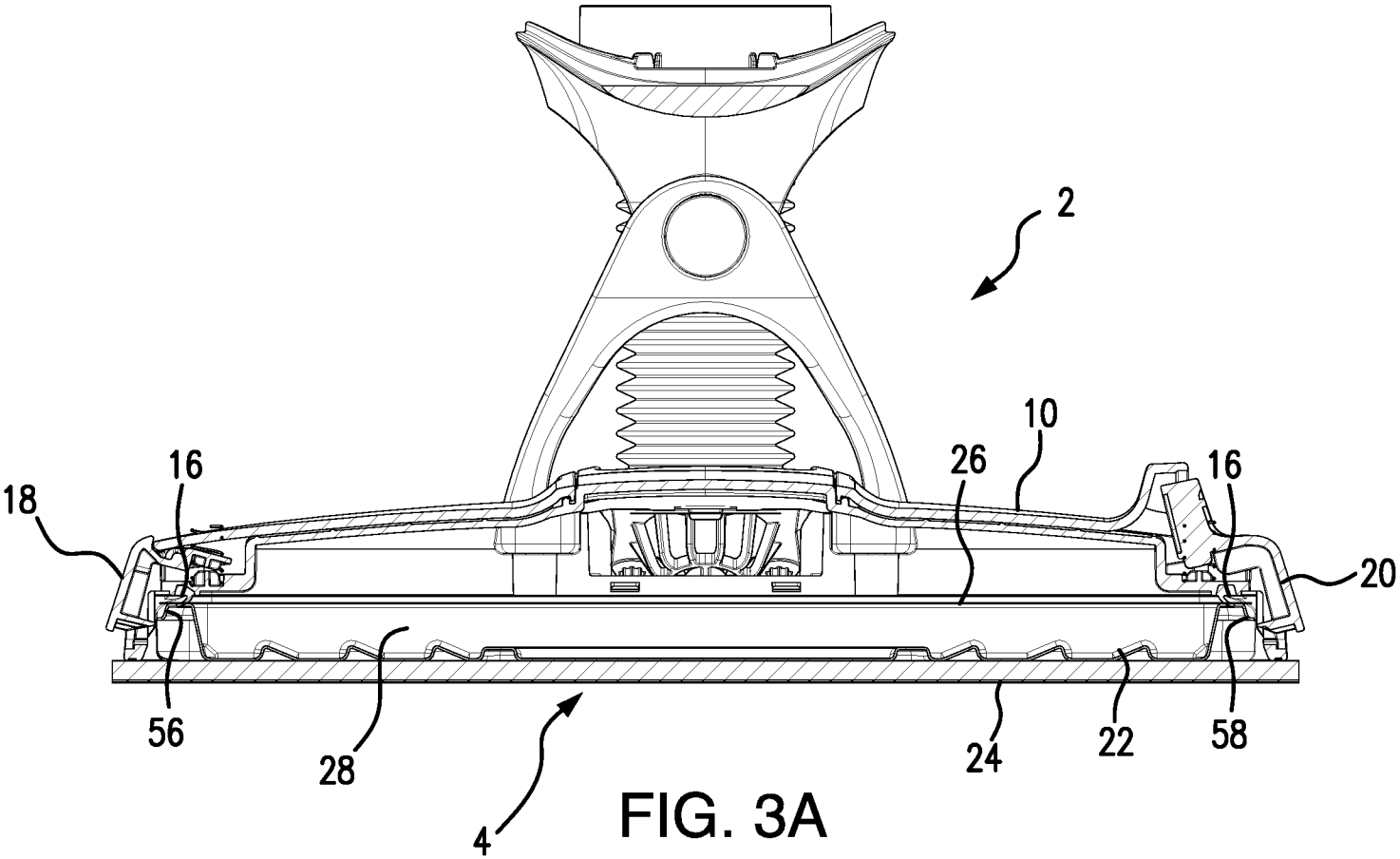
FIG. 3A shows a cross-sectional view of FIG. 1 along line 3A-3A showing the vacuum head and replacement head attached and with a connector arm in the open position.

FIGS. 1 and 2 illustrate a perspective view of a vacuum device 2 and a replacement head 3 that can be selectively attached and detached. The vacuum device 2 includes a handle 6, a vacuum body 8 that includes a suction source (not visible), a vacuum head 10, and a trigger 11 for selectively activating the suction source. The vacuum device 2 may also include a container for holding a fluid (e.g., a cleaning fluid), a jet nozzle 12 and a user-activated button 14 to selectively spray the fluid from the jet nozzle 12. The jet nozzle 12 is preferably aimed to spray fluid from the jet nozzle 12 to a position in front of the replacement head 4 when the button 14 is activated by the user during normal use. Referring now to FIGS. 3 and 3A, the vacuum head 10 includes a vacuum sealing surface 16 and at least two connector arms 18, 20. In the embodiment shown, at least one the connector arms 18 are movable between a closed position (FIG. 3) and an open position (FIG. 3A).

Figure 4:
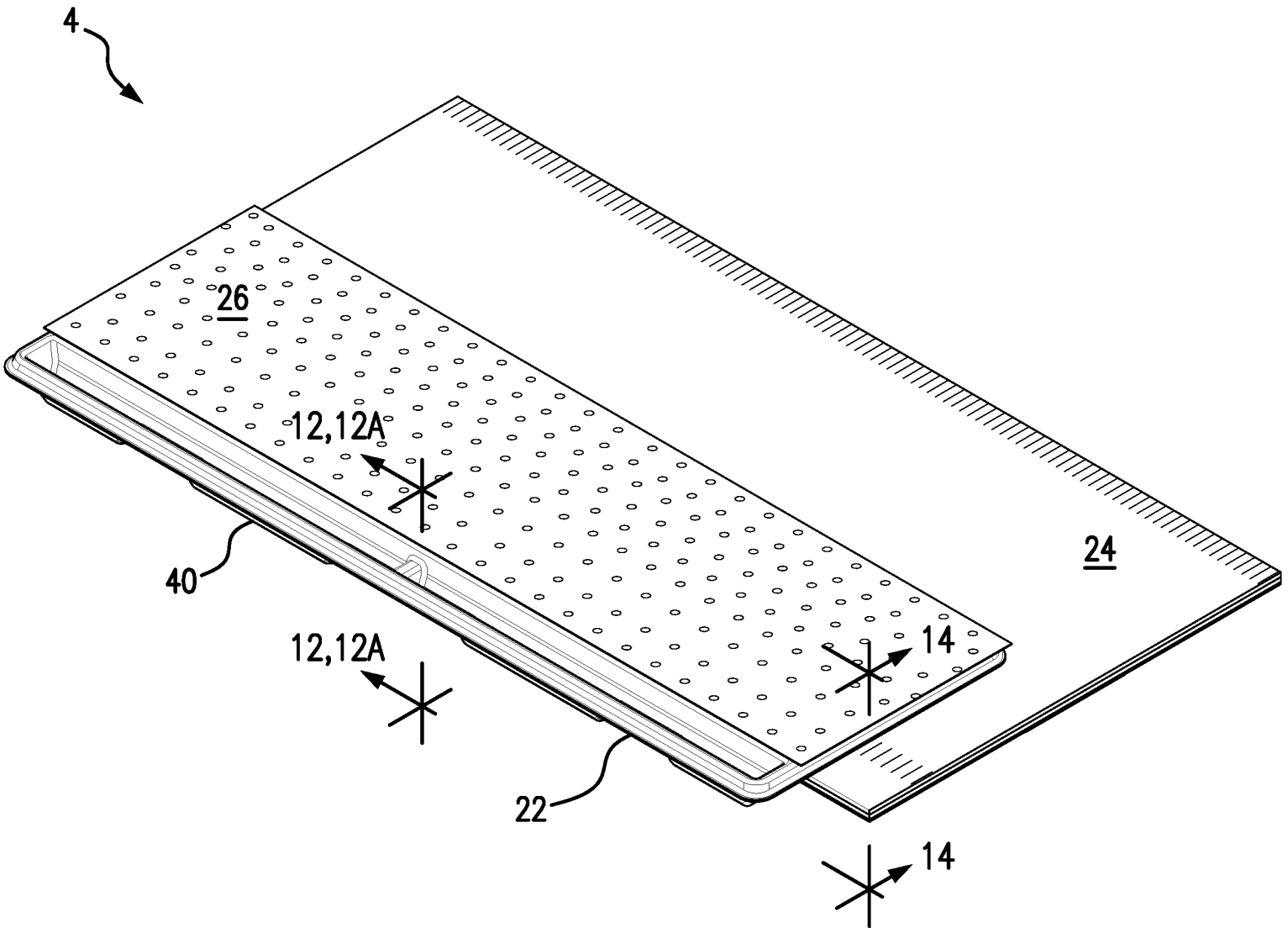
FIG. 4 shows an isometric view of the replacement head of the present invention.
Figure 5:
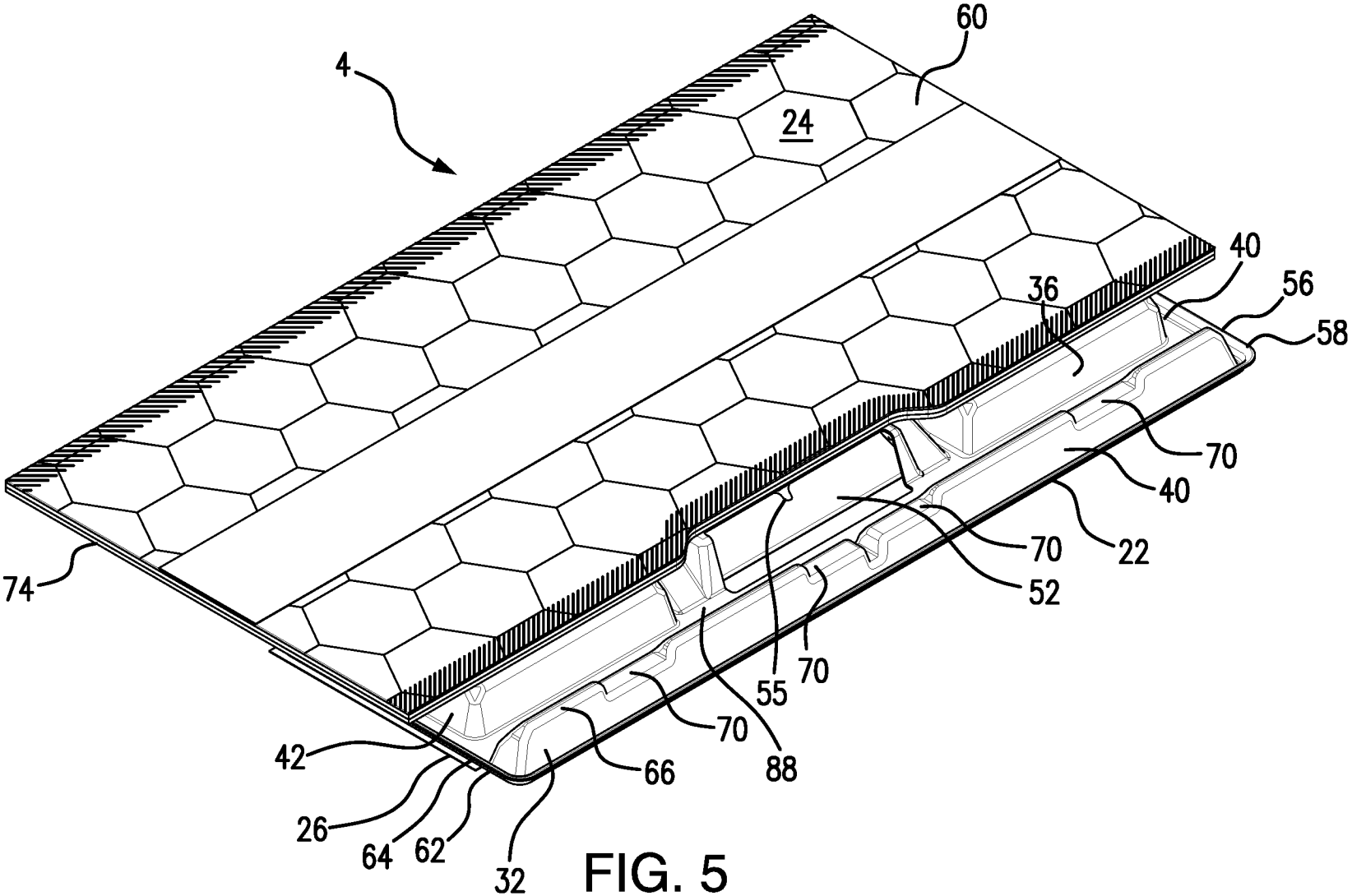
FIG. 5 shows an isometric view of the replacement head of FIG. 4 from a different angle.
Figure 6:
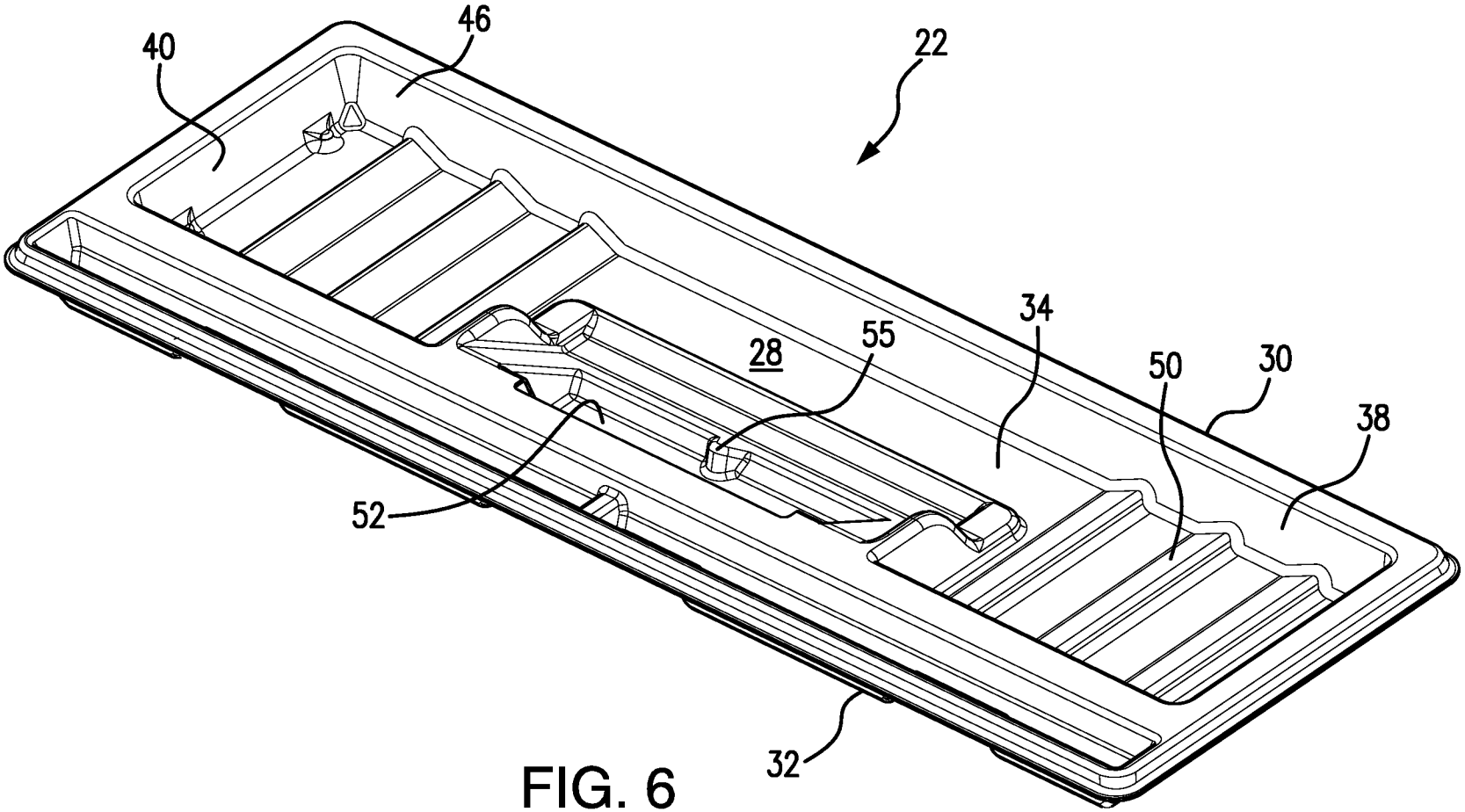
FIG. 6 shows an isometric view of the plastic tray of the present invention.
Figure 7:
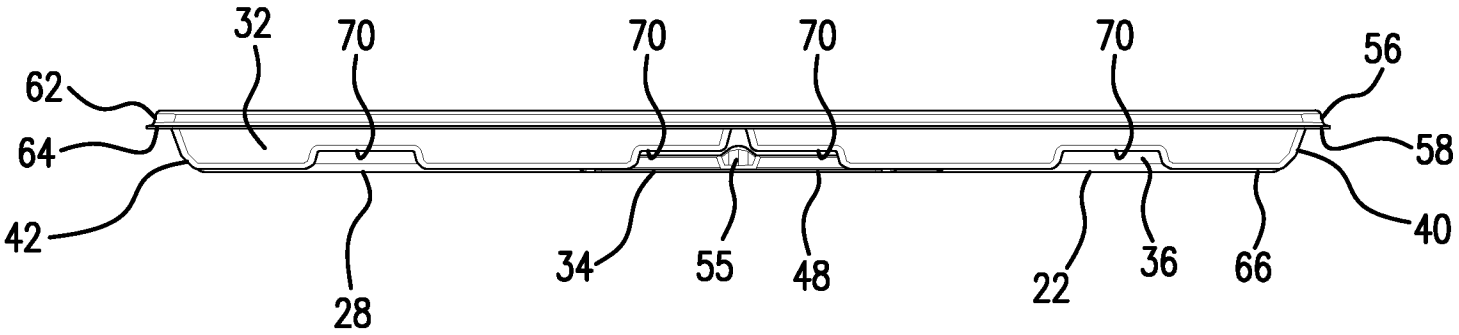
FIG. 7 shows a front view of the plastic tray of the present invention.
Figure 8:
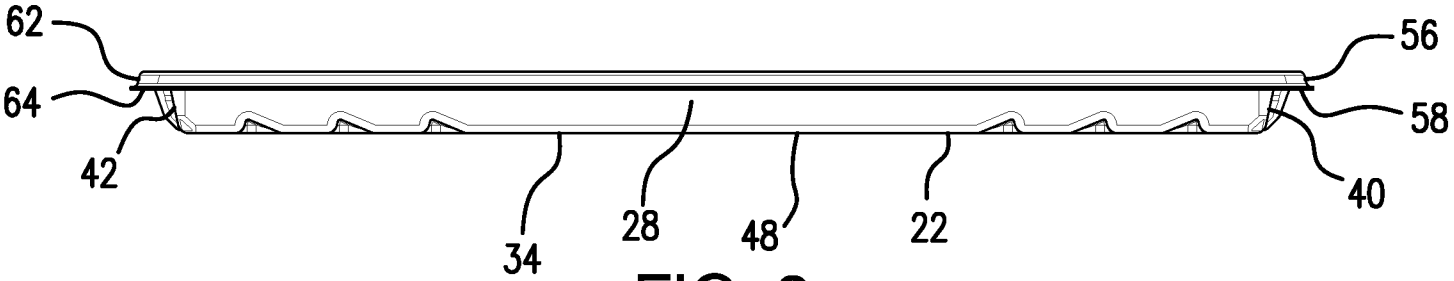
FIG. 8 shows a rear view of the plastic tray of the present invention.

Referring now to FIGS. 4-6, the replacement head 4 includes a plastic tray 22, a pad 24, and a filter 26. The plastic tray 22 includes a dust chamber 28, a sealing surface 30 (see e.g., FIG. 6) and a front guard portion 40.

The plastic tray 22 can be made of any suitable material (including non-plastics); however, materials that are inexpensive and readily disposable are preferred. For example, polyethylene terephthalate (or "PET") is considered a preferred material, in part, because PET is inexpensive and is readily thermoformed to the desired shape. Injection molding, blow molding or any other common manufacturing processes would also be acceptable and appropriate alternatives. As shown, the plastic tray 22 can be formed of a single, unitary piece, or can be comprised of two or more parts that are connected or joined during the assembly of the replacement head 4.

Figure 9:
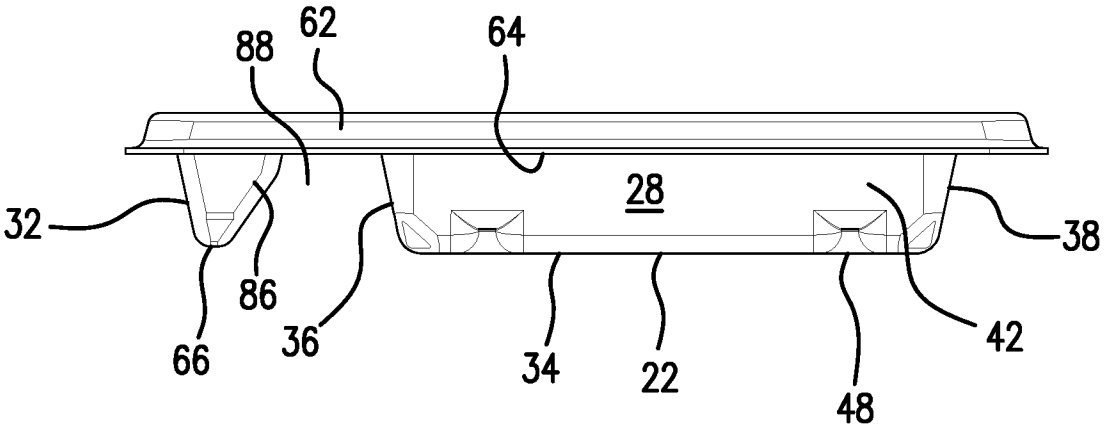
FIG. 9 shows a side view of the plastic tray of the present invention.
Figure 10:
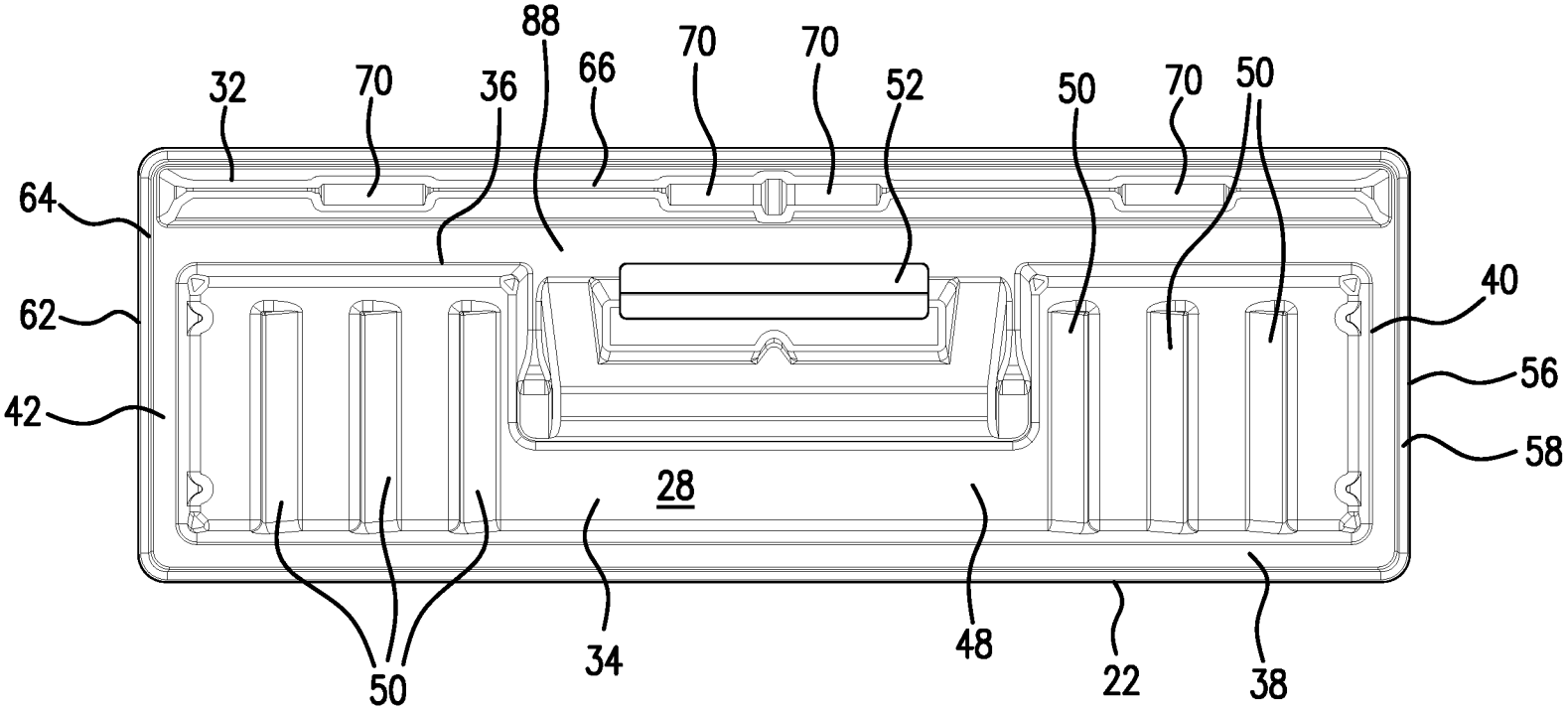
FIG. 10 shows a bottom view of the plastic tray of the present invention.

The plastic tray 22 as shown in FIGS. 6-12 includes a dust chamber 28 that is sized and shaped to collect and retain dust and debris that is suctioned into the plastic tray 22 during use. In the embodiment shown, the dust chamber 28 has a bottom wall 34, a front wall 36, a rear wall 38, a left wall 40, and a right wall 42. At the top of the dust chamber 28 is a top opening 46. Together, the walls and the top opening 46 generally define a volume of space capable of collecting and retaining common household dust and debris. One of skill in the art would understand that varying the size and shape of the walls and top opening 46 would increase or decrease the overall volume of the dust chamber without departing from the spirit of the invention. Although the rear wall 38, and left and right walls 40, 42 are shown as generally straight in FIGS. 9 and 10, the walls can include at least one curve or a bend, or include other features that make them not straight. For example, the front wall 36, as shown in FIG. 10, includes a series of curves and features. The curves and bends, among other benefits, increase the structural stability without increasing the thickness of the material. The bottom wall 34 defines a bottom surface 48 and may include ridges 50 (see FIGS. 8 and 10) to assist with retaining dust in place that has collected at the bottom of the dust chamber 28 during use. Alternatively, the bottom wall 34 can be generally flat.

Referencing now to FIGS. 3, 3A, 6 and 11, a sealing surface 30 extends circumferentially around the top opening 46 of the plastic tray 28. The sealing surface 30 is complementary to a vacuum sealing surface 16 on the vacuum head 10. The sealing surface 30 and the vacuum sealing surface 16 are either directly or (preferably) indirectly in contact with one another during use. In a preferred embodiment, where the sealing surface 30 and the vacuum surface 16 are indirectly in contact, the filter 26 may be sandwiched therebetween during use (see e.g., FIG. 3). To facilitate an effective seal that prevents a loss of suction during use, the sealing surface must be held in place with sufficient enough force against the vacuum sealing surface. In the embodiment shown, the sealing surface is a generally rectangular ring with a generally flat surface. The term generally rectangular is intended to describe a shape with a width greater than a length. However, the shape is not intended to be limited to a precise rectangle. For example, as shown in e.g., FIG. 10, the generally rectangular shape includes corners that are rounded. Other embodiments could have chamfered corners, or non-straight sidewalls.

Figure 11:
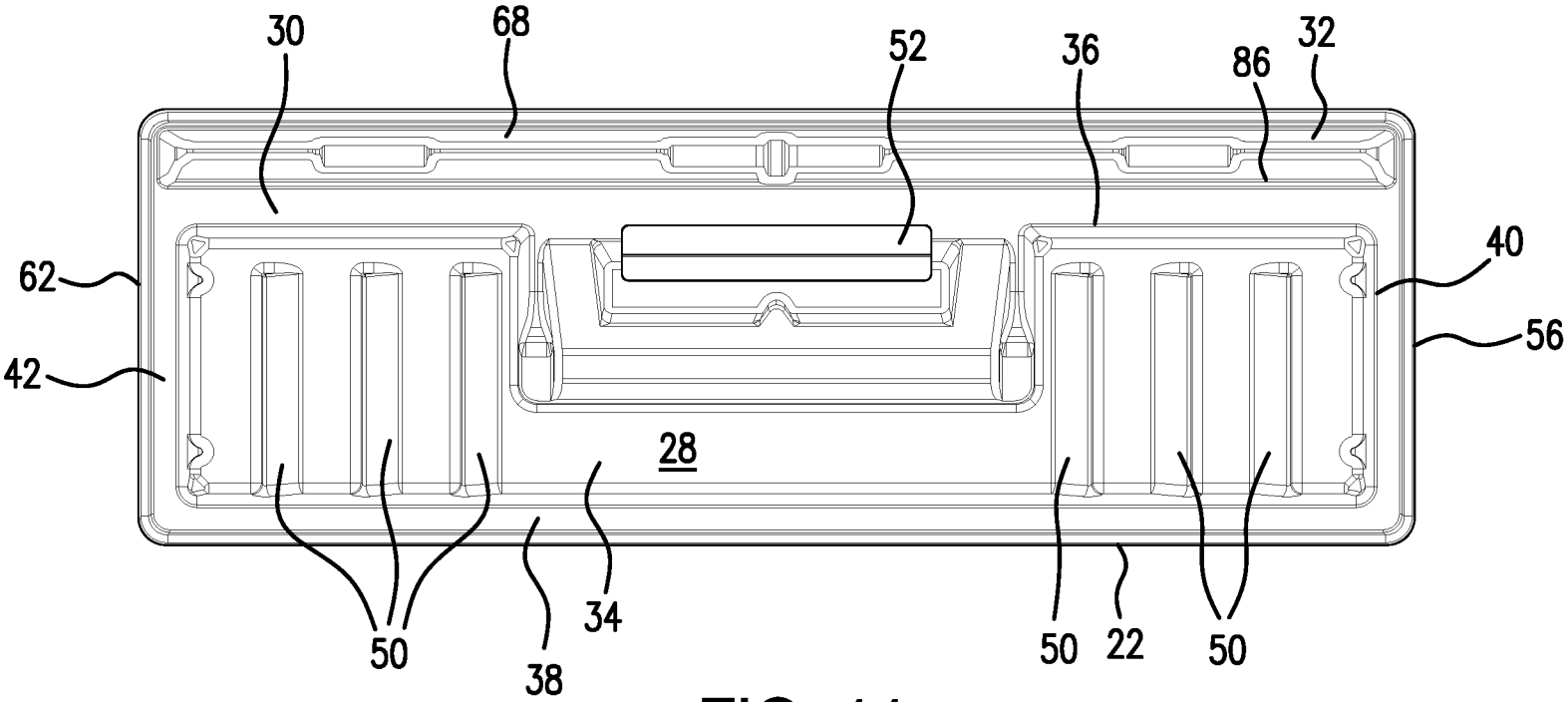
FIG. 11 shows a top view of the plastic tray of the present invention.

Referring to FIGS. 5, 10 and 11, at least one opening 52 exists that enables air, dust and debris to be drawn in from a position outside the replacement head 4 into the dust chamber 28 during use. In a preferred embodiment, a single rectangular-shaped opening 52 is located on the front wall 36 of the dust chamber 28. One of skill in the art would understand that alternative embodiments, although not shown, could include: multiple openings on a single wall; an opening that extends over two or more adjacent walls; at least opening on one wall, and another opening on another wall; or any combination of the above alternatives.

The opening 52 is preferably covered by an opening cover 54. The opening cover 54 can be made of any suitable material; however, in two preferred embodiments the material is either spunbond polypropylene, 1.25 oz and extruded PET, 0.7 Mil or 80 gsm spunbond PP. Preferably, the opening cover 54 is a cantilevered flap that, when open (FIG. 12A), permits air, dust and debris to enter into the dust chamber and, when closed (FIG. 12), generally covers the opening 52 to retain collected dust and debris within the dust chamber 28. While the cantilevered flap described above is a cost-effective solution, alternatives can include, for example, an opening cover 54 that is made of plastic or metal. The opening cover 54 is, preferably, attached to the underside of the filter 26. However, although not shown, the opening cover 54 can, for example, be attached to the plastic tray. In addition, while the preferred embodiment generally relies on the flexibility and resiliency of the opening cover 54 material employed, the opening cover 54 can also employ a hinge that defines a pivot axis, or a living hinge.

In some embodiment, and now referring FIG. 5, the opening may further include an opening rib 55. The opening rib 55 is preferably integral with the dust chamber 28 and provides a stop surface to prevent the opening cover 54 from becoming either stuck in the opening 52 or from exiting the opening 52 during either shipment or normal use.

Figure 13:
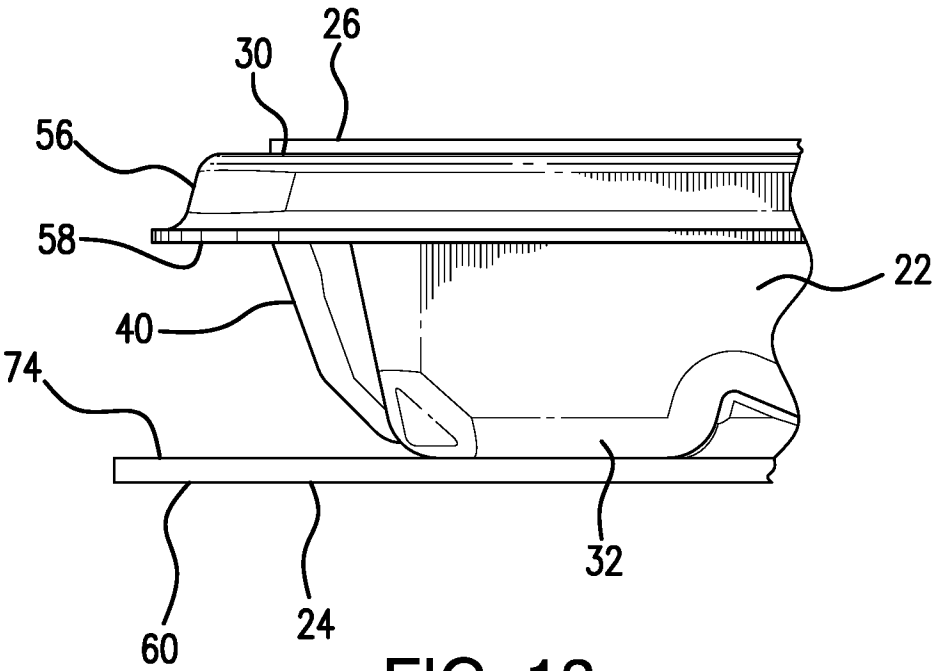
FIG. 13 shows an enlarged front view of one side of the replacement head.
Figure 14:
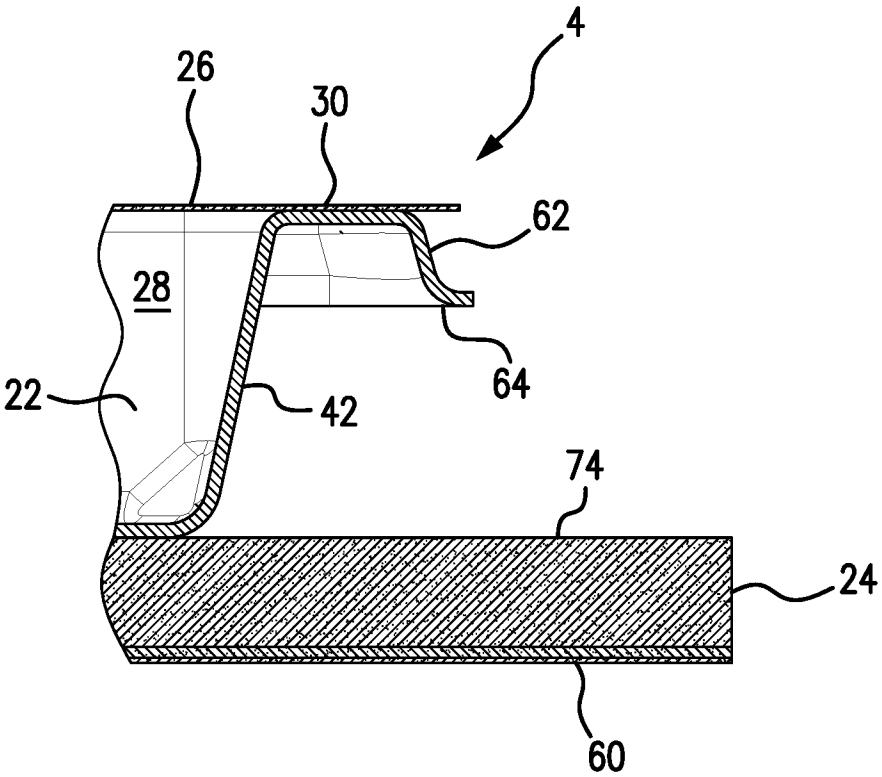
FIG. 14 shows a cross-sectional view of FIG. 4 along line 14-14 depicting the shape of the first connector lip.
Figure 15:
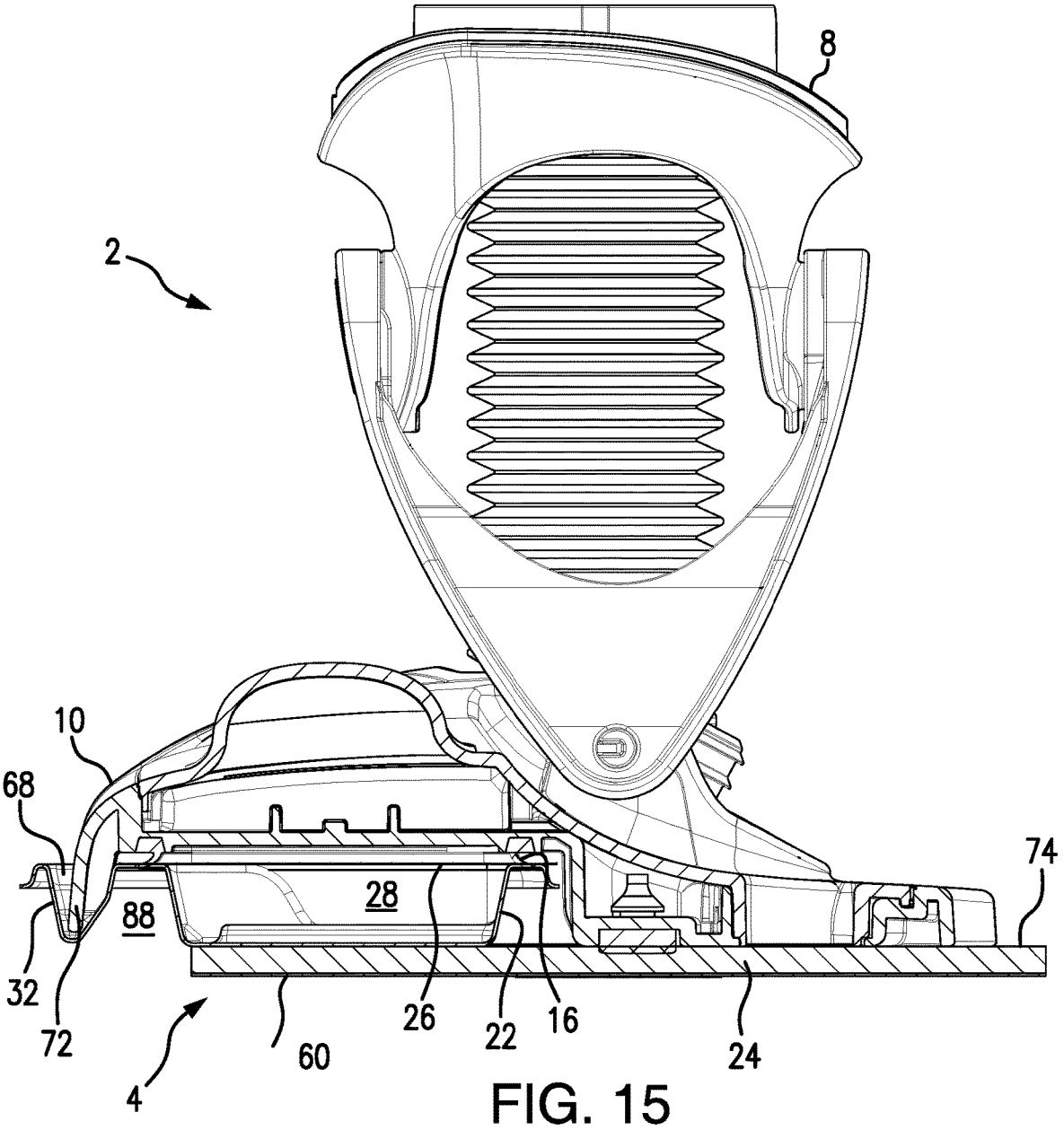
FIG. 15 shows a cross-sectional view of FIG. 1 along line 15-15 depicting the interaction between the vacuum head and the front guard of the plastic tray.

Referring to FIGS. 7-11 and 13, the first connector lip 56 extends outwards from the left wall 40 of the dust chamber 28, outside of the sealing surface 30. Also, at least a portion of the first connector lip 56 is located between the front wall 36 and the rear wall 38 of the dust chamber, as shown, e.g., in FIG. 11. The first connector lip 56 includes a lower surface 58 that is located below the sealing surface 30. More particularly, and as shown in FIGS. 13 and 14, the lower surface 58 of the first connector lip 56 is located between the level of the sealing surface 30 and the second surface 60 of the pad 24 (described in greater detail below). Even more particularly, the lower surface 58 of the first connector lip 56, in some embodiments, is closer to the sealing surface 30 than the second surface 60 of the pad 24. The cross-sectional shape of the first connector lip 56 may be of any chosen by the designer. However, it is preferred, in order to increase rigidity and reduce material, that the first connector lip 56 has a cross-sectional shape that includes at least one curve. The actual relative positioning of the lower surface 58 of the first connector lip 56 should be complementary to the design of the of the vacuum head 10 and connector arms 18, 20. In the locked position, as shown in FIG. 3, the connector arms 18, 20 of the vacuum head engage with the lower surface 58 of the first connector lip 56. When held in position by the connector arms 18, 20 of the vacuum head 10, the sealing surface 30 of the replacement head 4 is engaged with, either directly or indirectly, vacuum sealing surface 16.

In some embodiments, and now referring to FIGS. 10 and 11, the first connector lip 56 may extend rearward of the rear wall 38 and/or further forward of the front wall 36. In even further embodiments, the first connector lip 56 may extend forward of the front guard 32 (described below). The first connector lip 56 may be formed integrally with the other features of the plastic tray 22 (e.g., the dust chamber), or may be a separate element that is combined with the remaining features of the plastic tray 22 prior to end use.

Referring to FIGS. 7-11 and 13, the second connector lip 62 extends outwards from the right wall 42 of the dust chamber 28, outside of the sealing surface 30. Also, at least a portion of the second connector lip 62 is located between the front wall 36 and the rear wall 38 of the dust chamber 28, as shown, e.g., in FIGS. 10 and 11. Similar to the first connector lip 56 shown in FIGS. 13 and 14, the second connector lip 62 includes a lower surface 64 that is located below the level of the sealing surface 30 (see e.g., FIGS. 7 and 8). More particularly, the lower surface 64 of the second connector lip 62 is located between the level of the sealing surface 30 and the second surface 60 of the pad 24 (described in greater detail below). Even more particularly, the lower surface 64 of the second connector lip 62, in some embodiments, is closer to the sealing surface 30 than the second surface 60 of the pad 24. The cross-sectional shape of the second connector lip 62 may be of any chosen by the designer and may be the same as, or different than, the first connector lip 56. It is preferred that the second connector lip 62, for the same reasons stated above, has a cross-sectional shape that includes at least one curve. The relative positioning of the lower surface 64 of the second connector lip 62 should be set such that it is complementary to the design of the of the vacuum head 4 and connector arms 18, 20. In the locked position, as shown in FIG. 3, the connector arms 18, 20 of the vacuum head 4 engage with the lower surface 64 of the first connector lip 56. When held in position by the connector arms 18, 20 of the vacuum head, the sealing surface 30 of the replacement head 4 is engaged with, either directly or indirectly, vacuum sealing surface 16.

In some embodiments, and now referring to FIGS. 10 and 11, the second connector lip 62 may extend rearward of the rear wall 38 and/or further forward of the front wall 36. In even further embodiments, the second connector lip 62 may extend forward of the front guard 32 (described below). The second connector lip 62 may be formed integrally with the other features of the plastic tray 22 (e.g., the dust chamber 28), or may be a separate element that is combined with the remaining features of the plastic tray 28 prior to end use. In some embodiments, the first and second connector lips 56, 62 may be separate elements while, in other embodiments, such as the embodiment shown in, e.g., FIG. 6, the first and second connector lips 56, 62 may be interconnected across the front and/or rear of the plastic tray 22.

Referring now to FIGS. 5, 7, 9 and 10, the plastic tray 22 can include a front guard portion 32 that is located at least partially forward of the dust chamber 28. In the embodiment shown, the front guard portion 32 is located forward of the dust chamber 28 and defines a shaped bottom surface 66 and an interior space 68 and extends generally from the right side of the plastic tray 22 to left side. The cross-sectional shape of the front guard 32 can be any suitable shape; however, a generally triangular cross-section (as shown in FIG. 9) has been shown to have particular utility. The lowest portion of the bottom surface 66 is preferably in close proximity to the floor being cleaned to assist in controlling the airflow into the dust chamber 28. In some embodiments, as shown in, e.g., FIGS. 5 and 7, it is preferable that the front guard 32 includes one or more castellations 70. While it is desirable for sections of the front guard 32 to be in close proximity to the ground during the cleaning process, the castellations 70 provide sections that permit larger pieces of debris (e.g., pieces of cereal) to come into close proximity to the opening 52 of the dust chamber 28 in order to be drawn into the dust chamber 28. The interior space 68 of the front guard 32, as shown in FIG. 11, provides space to receive corresponding, complementary features 72 on the vacuum head 10. Preferably, the interior space 68 is located at an asymmetrical location on the plastic tray 22 such that, if the replacement head 4 were to be unintentionally reversed by the end user, the features on the front of the vacuum head 10 would contact plastic tray material (e.g., the sealing ring 30), thus cueing the end user that the replacement head 4 is being attached incorrectly. The vacuum head 10 may include a single feature that enters the interior space 68 of the front guard 32 during attachment, or, as shown in FIG. 3, may include multiple features. As noted above, the interior space 68 may be generally triangular in shape. In these embodiments, the generally converging walls of the interior space 68 function to assist the user to position the vacuum head 10 into the proper attachment position by urging the vacuum head either slightly forwards or backwards during attachment.

Referring now to FIG. 9, the interior space 68 may have a partial vertical wall 86 on the side closer to the dust chamber 28. The partial vertical wall 86 can interact with features on the vacuum head 10 to prevent motion relative to the vacuum head 10 during a pull-back stroke.

Located between the front guard portion 32 and the dust chamber 28 is the front suction chamber 88. The front suction chamber 88 extends across the plastic tray 22 from side to side. The front suction chamber 88, as shown in FIG. 9, is bounded on the front by the rear side of the front guard portion 32 and at the rear by the front wall 36 of the dust chamber and the opening 52. The size and shape can be determined by the designer; however, it is preferable to shape the front suction chamber 88 in such a manner to encourage airflow to direct dust, dirt towards the opening(s) 52.

The filter 26 is made of a suitable material that will permit air to pass therethrough during use, yet block at least a substantial portion of the dust that is drawn into the dust chamber 28 during cleaning. In addition, it is desirable for the filter 26 to have the ability to absorb and/or block moisture prior to entering the vacuum device 2. It is desirable to choose a material that is inexpensive to manufacture, readily cut to size and easily attachable to the plastic tray 22. In the embodiment shown, the filter 26 is a non-woven, hydrophobic material made of SMS Polypropylene, 40 gsm. In embodiments where the filter material is printable, an additional printed pattern may appear on the filter 26 that includes, e.g., a logo or directions for use.

The filter 26 is attached to the plastic tray 22 such that substantially the entire top opening 46 is covered, as shown in FIG. 4. It is desirable that most, if not all, of the air that is drawn into the dust chamber 28 during vacuuming passes through the filter 26 prior to entering the vacuum device 2 so that the amount of dust, debris and moisture that enters into, and therefore can potentially damage, the suction source is minimized. The embodiment shown in FIG. 3, the filter 26 is attached to the sealing surface 30 such that, when the replacement head 4 is attached to the vacuum head 10, the filter 26 is sandwiched between the sealing surface 30 of the plastic tray 22 and the vacuum sealing surface 16. While it is desirable for the filter 26 to cover substantially all of the top opening 46 of the dust chamber 28, it is preferable that the filter 26 does not cover interior space 68 of the front guard 32 so that features 72 on the vacuum head 10 can enter into the interior space 68 of the front guard 32 unimpeded during attachment. The filter 26 may be attached to the plastic tray 22 in any acceptable manner. Suitable methods include using heat to bond the materials together, as well as the use of glues and adhesives. While it is preferable that the filter 26 is attached in a permanent manner to the plastic tray 22, other embodiments can have a removable connection. Even further embodiments can include an end user placing the filter 26 over the top opening 46 during use.

Figure 16:
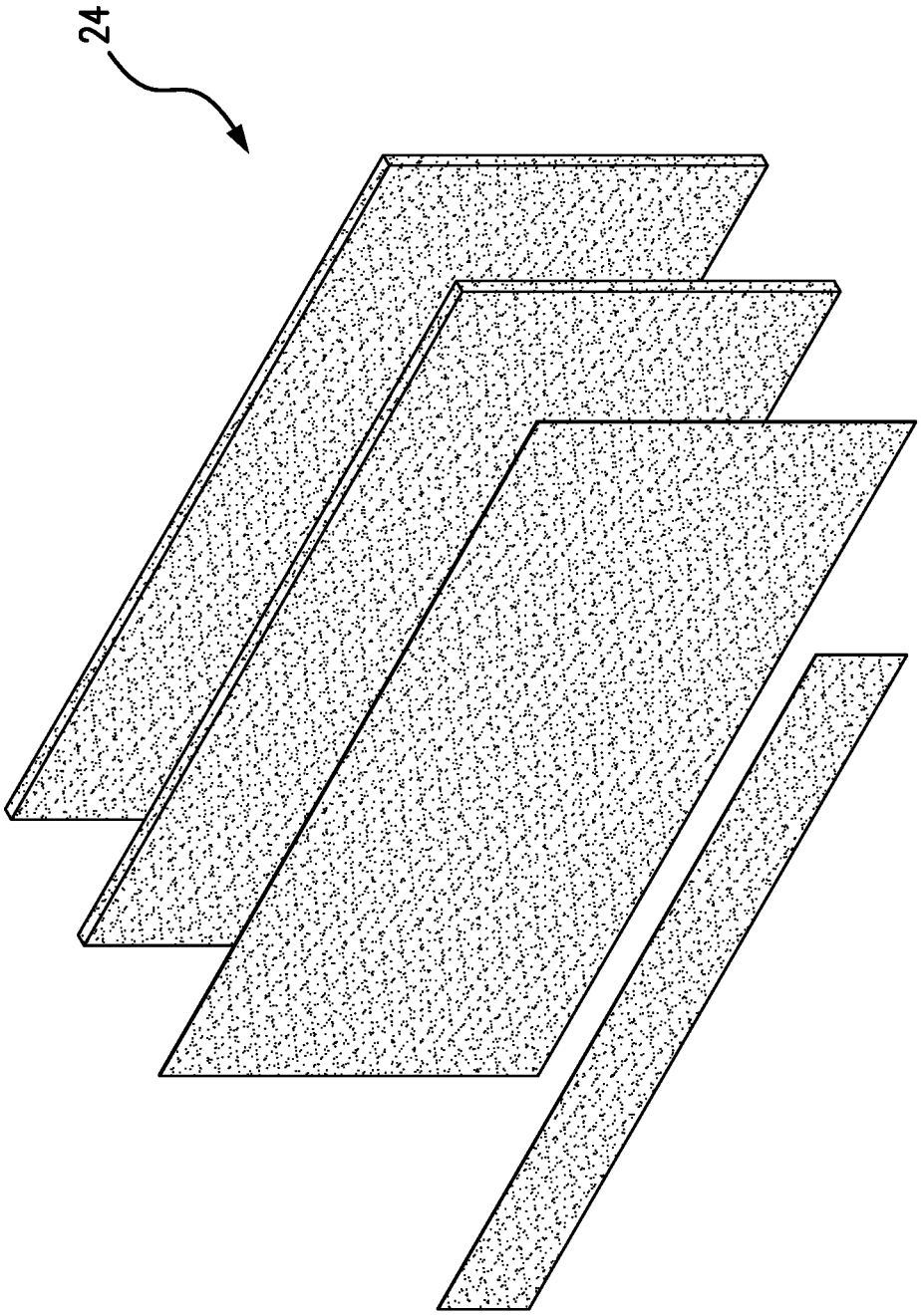
FIG. 16 shows an exploded view of one embodiment of the pad of the present invention.

The pad 24 includes a first surface 74 and a second surface 60 and is made from any suitable material that, preferably, can be used to scrub the surface being cleaned and/or absorb moisture. Pads 24 are well-known in the art and can include one or more layers. For example, a pad with a single layer made of 100% PET material or Carded Spunlace PET, 58 gsm; Spunbond PP, 10 gsm may be used. Or, as shown in FIG. 16, the pad 24 can include, e.g., four layers that each provide utility (e.g., absorption, retention, scrubbing). Exemplary layers include:

Layer 1: Air Laid Retention Layer; 180 gsm, 47% Pulp, 53% Bico

Layer 2: Air Laid Acquisition Layer; 100 gsm, 47% Pulp, 53% Bico

Layer 3: Face Layer; Carded Spunlace PET, 58 gsm; Spunbond PP, 10 gsm

Layer 4: Multi-function Strip; Melt Blown PP, 35 gsm

Referring to FIGS. 4 and 5, a multi-layer pad 24 is shown. In order to bond the various layers together, multiple methods are shown. In FIG. 5, the layers are ultrasonically welded together in a continuous manner along the entire edge. In certain embodiments, additional welds can be made in the body of the filter, as shown in a generally hexagonal pattern in FIG. 5. The continuous weld along the front and rear edges tends to provide a suitable bond between the layers to prevent delaminating. In FIG. 4, tack welding at localized positions along the front and rear edges is shown. In some embodiments, a total of about eight (8) weld locations are provided. In other embodiments, using approximately about fifty (50) weld locations has been found to work suitably well. In addition, and still referring to FIG. 4, the spaced apart weld locations may be positioned along the edge of the pad 24. In other embodiments, as shown along the front edge of the pad in FIG. 4, the weld locations may be set back. By welding the layers together in localized positions, it has been shown that the welds maintain acceptable attachment between the layers, but allow for some expansion therebetween. The expansion between the welds has been found to permit additional absorption of liquids during use. For example, in some instances, where a continuously welded multi-layer pad might tend to push an amount of water that is on the floor either in front of or behind the vacuum device 2, an intermittently welded pad may absorb the liquid due to slight delamination that can occur between the welds. In embodiments where the welds are set back from the edge of the pad 24, localized delamination can be increased and, in certain circumstances, result in increased performance. The number of welds and location of the welds between the front and rear of the pad 24 can be the same, or different depending on the discretion of the designer.

The outer shape of the pad 24 can be any suitable known to one of skill in the art. As shown in FIG. 5, the pad 24 can be generally rectangular. The first surface 74 of the pad 24 is attached to the bottom surface 48 of the dust chamber 28 such that the second surface 60 of the pad 24 material is in contact with the floor during cleaning. Preferably, the first surface 74 of the pad 24 covers at least most of the bottom surface 48 of the dust chamber 28 and, even more preferably, covers the entirety. The pad 24 may extend outward from the bottom surface 48 of the dust chamber 28. As shown in FIGS. 4 and 5, the pad 24 extends rearward and to the sides of the bottom surface 48 of the plastic tray 28. Although it is acceptable for the pad 24 to extend forward of the front wall 36 of the dust chamber 28, such an arrangement has the potential to hinder usability by, e.g., blocking the opening 52 to the dust chamber 28 and/or the potentially causing the pad 24 to fold or buckle when the vacuum device 2 is pushed forward by the user during cleaning.

The pad 24 can be attached in any suitable manner. Preferably, the first surface 74 of the pad 24 is attached to the bottom surface 66 of the dust chamber 28 in a permanent manner. Suitable methods include using heat bonding or adhesives. Alternatively, the pad 24 can be replaceable and attached in a removable manner by, e.g., hook and loop fasteners.

Figure 12:
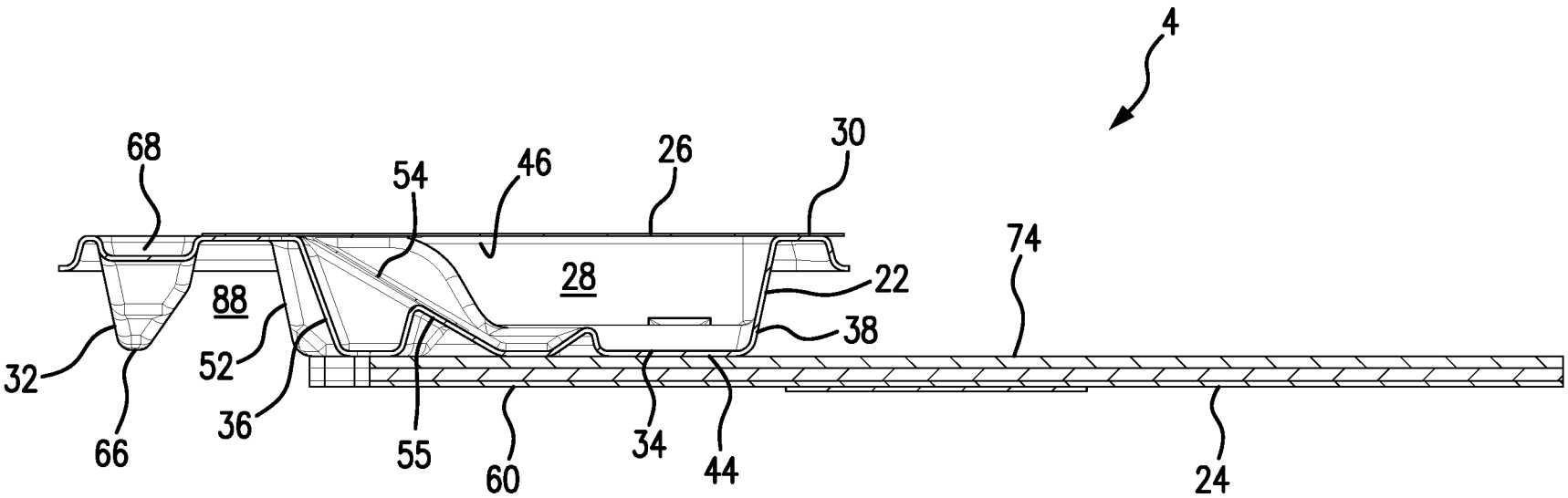
FIG. 12 shows a cross-sectional view of FIG. 4 along line 12-12 depicting the opening cover in a closed position.
Figure 12A:
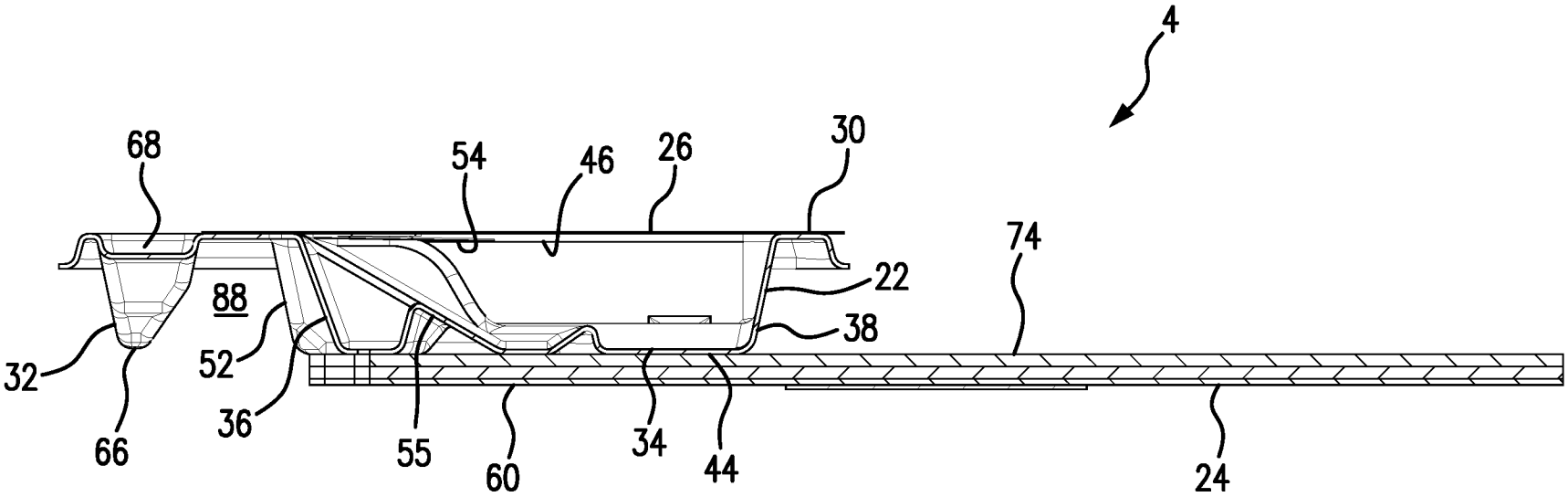
FIG. 12A shows a cross-sectional view of FIG. 4 along line 12A-12A depicting the opening cover in an open position.

In use, and now referring to FIGS. 1-3A, the end user moves at least one of the connector arms 18, 20 of the vacuum head 10 to the open position and places a replacement head 4 such that the filter 26 material is sandwiched between the sealing surface 30 of the plastic tray 22 and the vacuum sealing surface 16. The at least one connector arm 18, 20 is then released such that the connector arms engage the first and second connector lips 56, 62 on the plastic tray, holding the replacement head 4 in place for use. The user then activates the vacuum device 2, creating suction. The air drawn into the dust chamber 28 causes the opening cover 54 to move to an open position (as shown in FIG. 12A). As the user moves the vacuum device 2 and replacement head 4 over the floor to be cleaned, the suction source draws air, dirt and debris from the area in front of the replacement head 4 under the front guard 32, and through the opening 52 into the dust chamber 28. The air, dust and debris, once inside the dust chamber 28, are then drawn towards the filter 26 where the air passes through. The dust and debris are not able to pass through the filter 26 and are retained in the dust chamber 28. As desired, the user may activate the button 14 on the vacuum device 2 to spray fluid onto the floor in front of the replacement head 4. The user can then thoroughly clean the floor using the second surface 60 of the pad 24 to scrub the floor with cleaning fluid.

During the cleaning process, one or more of the following will occur: the dust chamber 28 will fill with dust and debris, the filter 26 will become clogged, and the pad 24 will become soiled. The user, at any time, may selectively replace the replacement head 4 by moving at least one of the connector arms 18, 20 to the open position, thereby releasing the first and second connector lips 56, 62 from engagement with the vacuum head 10. Advantageously, in the embodiment described, the user can replace the entire replacement head 4 all at once and replace with a refreshed replacement head 4 for future use with minimal mess.

Figure 17:
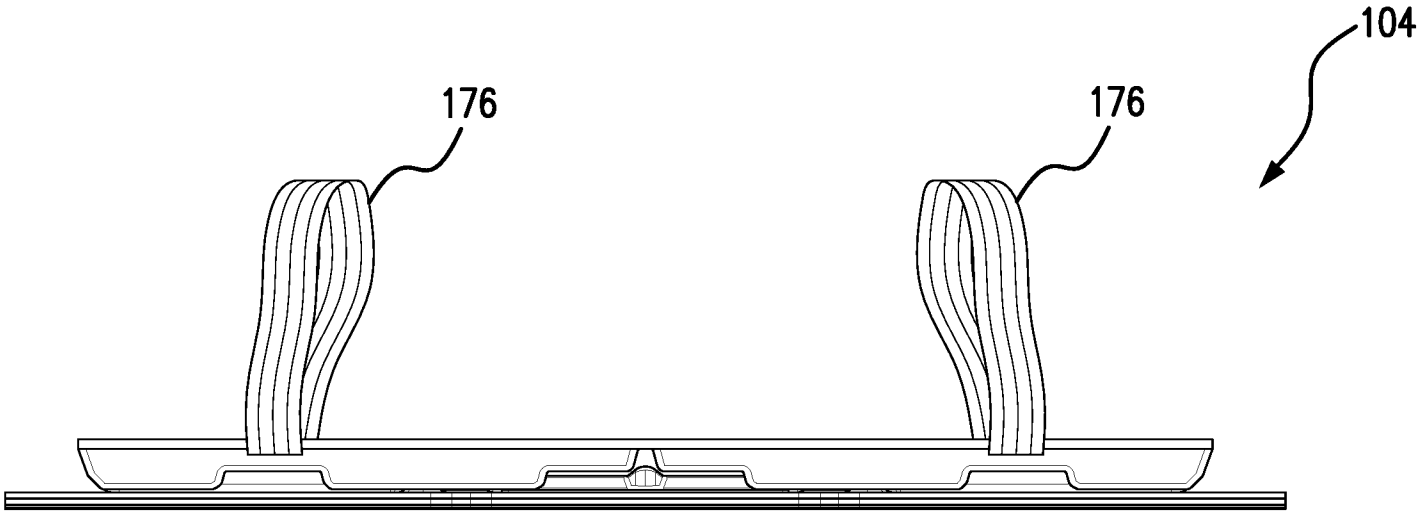
FIG. 17 shows an alternate embodiment of the present invention that utilizes elastic straps.

Alternative embodiments to the ones described above exist without departing from the spirit and scope of the present invention. For example, rather than using first and second connector lips 56, 62 to removably attach the replacement head 4 to the vacuum head 10, one or more elastic straps 176 can be employed. As shown in FIG. 17, two elastic straps 176 affixed to the replacement head 104. During use, the user wraps the elastic straps 176 around either side of the vacuum head 4 (of FIG. 2) in order to retain the replacement head 104 in place during use.

Figure 18:
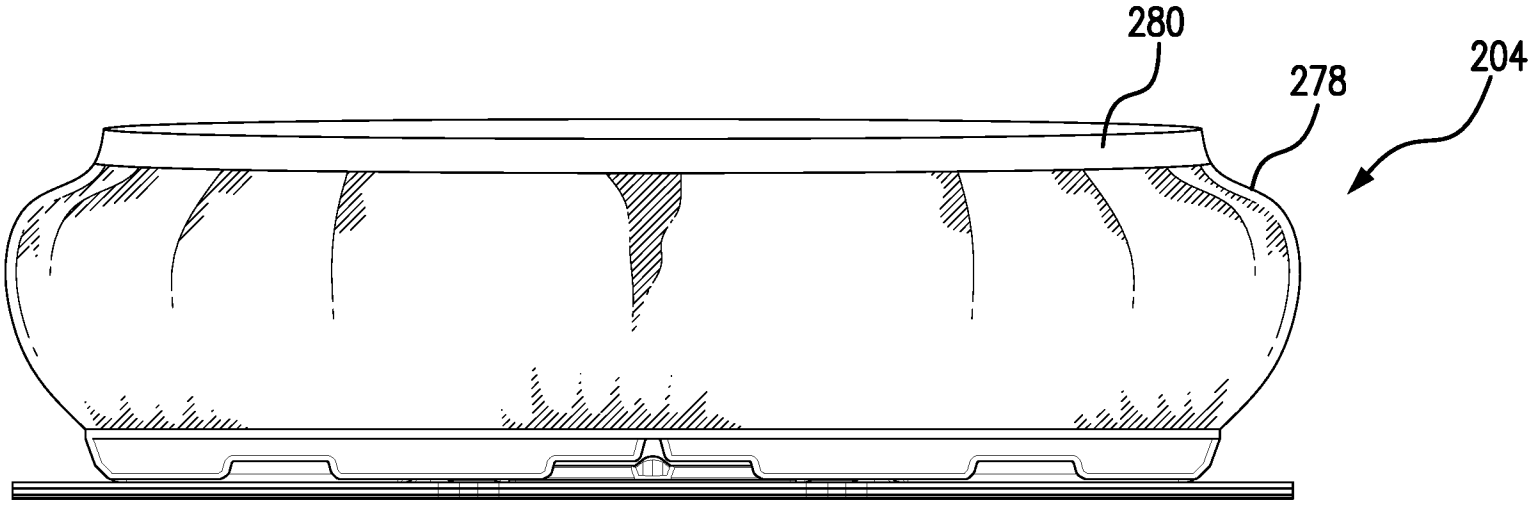
FIG. 18 shows an alternate embodiment of the present invention that utilizes a "shower cap" style connector.

Referring to FIG. 18, another embodiment utilizes a "shower cap" method of attachment. In this embodiment, rather than first and second connector lips 56, 62, a ring of flexible material 278 is attached to the replacement head (and preferably the plastic tray). The flexible material 278 can include an additional elastic strap 280, as shown, to ensure proper connection between the replacement head 204 and the vacuum device 2 of FIG. 2.

Figure 19:
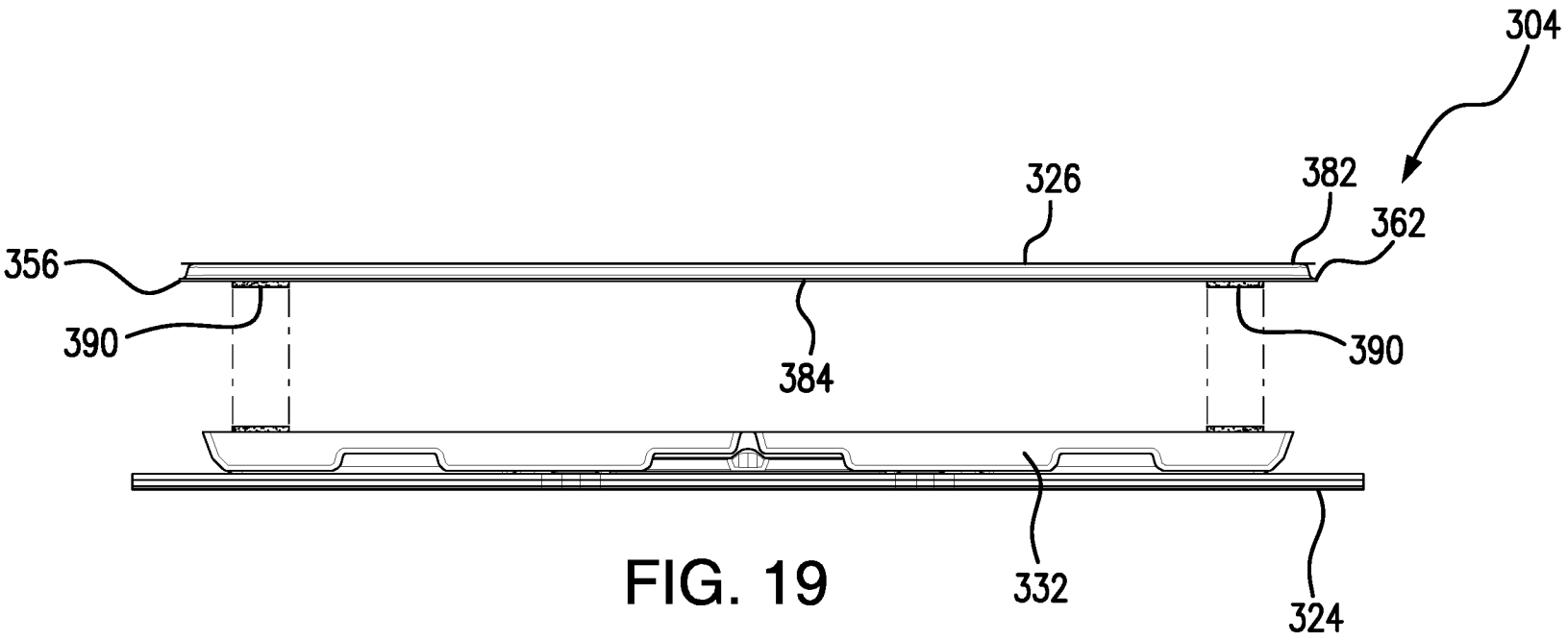
FIG. 19 shows an alternate embodiment of the present invention where the replacement head is comprised of multiple elements that are not permanently attached to one another.

Referring now to FIG. 19, a further embodiment is shown wherein the replacement head 304 includes multiple portions that are not permanently connected. A first interconnect portion 382 includes a first and second connector lips 356, 362 that connect to the vacuum head 4 (of FIG. 2) in similar fashion to those described above in previous embodiments. The first interconnect portion 382, as shown, seals with the vacuum sealing surface on one side and includes an opening 384 to allow air to pass therethrough towards the suction source during use. The first interconnect portion 382 further includes mechanical connectors 390 (e.g., mechanical connectors, hook and loop fasteners, etc) that attach to additional portion(s) (i.e., the filter 326, dust chamber 328, front guard 332, and pad 324) of the replacement head 304 to the first interconnect 382. Although not shown, the first interconnect portion 382 can include one or more elements of the replacement head (e.g., the front guard and/or the filter) thereon. Likewise, the filter 326 in this embodiment could be attached to the dust chamber 328, or can be a standalone item.

One of skill in the art would know that additional embodiments, or variations to the above description can be made without departing from the spirit or scope of the invention. For example, while various alternatives for connecting the replacement head to the vacuum head have been disclosed (i.e., first and second connector lips, elastic straps, etc), additional devices that utilize more than one of the disclosed methods or obvious alternatives are considered within the scope of the invention. In addition, the term about is used herein to describe a range of additional values known to one of skill in the art to be equivalent to the stated range. When the term about is used with regard to a range, the term is intended to apply to both ends of the range.

We claim:

1. A replacement head, comprising:

a pad having a layer of at least one material, the pad defining a first surface and a second surface generally facing away from the first surface;

a tray defining a dust chamber having a first opening and a sealing surface, the tray being connected to the first surface of the pad;

a first connector formed on the tray and extending outward from the sealing surface, the first connector being positioned between the sealing surface and the second surface of the pad;

a second connector formed on the tray and extending outward from the sealing surface, the second connector being positioned between the sealing surface and the second surface of the pad; and a filter permanently connected to the tray to allow suction force to be applied to the dust chamber while retaining debris within the dust chamber.

2. The replacement head of claim 1, wherein the tray includes a plurality of walls and a second opening that extends through at least one of the plurality of walls.

3. The replacement head of claim 1, wherein the tray includes a bottom wall and the bottom wall includes ridges.

4. The replacement head of claim 1, wherein the pad has more than one layer of material.

5. The replacement head of claim 1, wherein the pad is generally rectangular in shape.

6. The replacement head of claim 1, wherein the pad is permanently affixed to an exterior bottom surface of the tray.

7. The replacement head of claim 1, wherein the pad covers at least a portion of an exterior bottom surface of the tray.

8. The replacement head of claim 1, wherein the pad includes at least one layer that can absorb fluids.

9. The replacement head of claim 1, wherein the filter is comprised of a non-woven material.

10. The replacement head of claim 1, wherein the filter is affixed to the sealing surface.

11. The replacement head of claim 1, wherein the first connector has a cross-sectional shape that includes at least one curve.

12. The replacement head of claim 1, wherein the first connector extends from a position rearward of a rear wall of the dust chamber to a position forward of a front wall of the dust chamber.

13. The replacement head of claim 1, wherein the second connector has a cross-sectional shape that includes at least one curve.

14. The replacement head of claim 1, wherein the second connector extends from a position rearward of a rear wall of the dust chamber to a position forward of a front wall of the dust chamber.

15. The replacement head of claim 1, wherein the first and second connectors are integral with the tray and extend along at least one of a rear wall and a front wall.

16. The replacement head of claim 1, wherein the first and second connectors are integral and extend along both a rear wall and a front wall and fully encircle the first opening.

17. The replacement head of claim 1, wherein a lower surface of the first connector is closer to the sealing surface than the second surface of the pad.

18. The replacement head of claim 1, wherein surface of the second connector is closer to the sealing surface than the second surface of the pad.

19. The replacement head of claim 1, wherein the tray includes a front guard portion and a front wall, and at least a portion of the front guard portion is located forward of the front wall.

20. The replacement head of claim 19, wherein at least a portion of the first connector is located aft of the front guard portion.

21. The replacement head of claim 19, wherein at least a portion of the second connector is located aft of the front guard portion.

22. The replacement head of claim 21, wherein at least a portion of both the first connector and the second connector is located aft of the front guard portion.

23. The replacement head of claim 1, wherein a front suction chamber is located at least partially between a front guard portion and the dust chamber and is located at an exterior edge of the replacement head.

24. The replacement head of claim 1, wherein the pad includes at least a first and a second layer, the first and second layers of the pad being ultrasonically welded together.

25. The replacement head of claim 24, wherein the ultrasonic weld is generally continuous along at least one edge of the pad.

26. The replacement head of claim 24, wherein at least one edge of the pad has at least two localized weld locations that are spaced apart from one another.

27. The replacement head of claim 24, wherein the ultrasonic weld is positioned away from an edge of the pad.

28. A replacement head, comprising:

a pad having a layer of at least one material, the pad having a cleaning surface configured to be positioned on a surface to be cleaned;

a tray having a lower surface connected to the pad and the tray defining a dust chamber therein, a portion of the dust chamber defining an air permeable passage from an interior of the dust chamber to an exterior of the dust chamber, the portion configured for coupling to a source of suction, the tray including an inlet for allowing debris to flow into the dust chamber;

a filter permanently connected to the tray to allow suction force to be applied to the dust chamber while retaining debris within the dust chamber;

a first connector surface on a first side of the tray, the first connector surface formed on the tray and positioned outward and downward from an upper surface of the tray and positioned between the air permeable passage and the pad;

a second connector surface on a second side of the tray, opposite to the first side, the second connector surface formed on the tray and positioned outward and downward from the upper surface of the tray and positioned between the air permeable passage and the pad.

29. The replacement head of claim 28, wherein the filter covers at least a portion of the air permeable passage.

* * * * *